US005173884A

United States Patent [19]

O'Connell

[11] Patent Number: 5,173,884

[45] Date of Patent: Dec. 22, 1992

[54] BOTTLE CAP TIMEPIECE

[76] Inventor: O'Connell, 5423-H Spanish Oak La., Agoura, Calif. 91301

[21] Appl. No.: 529,237

[22] Filed: May 25, 1990

[51] Int. Cl.[5] ..... G04C 3/00; G04C 5/00

[52] U.S. Cl. ..... 368/281; 368/294; 368/296

[58] Field of Search ..... 368/294, 296, 223-239, 368/296-286; 224/165-180

[56] References Cited

U.S. PATENT DOCUMENTS

| | | | |
|---|---|---|---|
| D. 220,051 | 3/1971 | Gsell | 368/282 |
| 1,838,790 | 12/1931 | Schwob et al. | 368/282 |
| 2,155,842 | 4/1939 | Ruger | 368/282 |
| 2,229,979 | 1/1941 | Kramer | 368/282 |
| 3,284,998 | 11/1966 | Nardin | 368/282 |
| 4,379,644 | 4/1983 | Capolupo et al. | 368/282 |
| 4,403,870 | 9/1983 | Thompson et al. | 368/282 |

*Primary Examiner*—Bernard Roskoski
*Attorney, Agent, or Firm*—Timothy T. Tyson

[57] ABSTRACT

A crown seal cap blank (22) (when a crown seal cap blank is swaged on a bottle it is commonly called a bottle cap), which may have a trademark (30) thereon, is provided for the face of a timepiece (100) and, in particular, a wrist watch (20). A timepiece (100) utilizing the crown seal cap blank (22) as a face is provided in which colors of other timepiece elements may be used to augment and enhance the appearance of the crown seal cap blank (22) and its trademark (30).

11 Claims, 2 Drawing Sheets

BOTTLE CAP TIMEPIECE

TECHNICAL FIELD

The present ivnention pertains to timepieces, and more particularly, to novelty timepieces.

BACKGROUND ART

Timepieces are used primarily to know the time. However, they may also give pleasure to their owner by their appearance. Those characteristics of appearance that will please an owner are a complex function of the owner's age and background, the time of day, the occasion, the mood of the moment and many other diverse factors. In the case of a timepiece worn on the body, such as a wrist watch, the clothes the owner is wearing are also a factor. Consequently, many people possess more than one timepiece and, in the case of wrist watches particularly, select from them to meet their immediate need.

The timepiece face is unusually important in meeting these needs since it is the most visible element of the timepiece. Color, humor and a pleasing shape are among the appearance characteristics of a timepiece face that can give pleasure to the owner under certain combinations of the factors mentioned above. Therefore, a timepiece, and particularly a timepiece face, that could combine color, humor and a pleasing shape would be of considerable utility.

DISCLOSURE OF INVENTION

In accordance, therefore, with an embodiment of the present invention, a face for a timepiece is provided that comprises a crown seal cap blank. Crown seal cap blank is the industry term for a crown seal closure (the common term for crown seal closure is bottle cap) prior to the capping operation in which the skirt of the blank is swaged inward to contact the bottle rim; after the swaging operation the altered blank is called a crown seal closure. The crown seal cap blank, therefore, has a skirt that flares downward and outward in an attractive manner which is particularly appropriate and pleasing for the face and margin of a timepiece.

In accordance with one embodiment of the invention, the crown seal cap blank may have a design on its upper surface. This adds color to the attractive form of the crown seal cap blank and enhances its appearance as a timepiece face.

In accordance with another embodiment of the invention, the crown seal cap blank may have a trademark on its upper surface. This adds color, humor and a sense of wearer identification to the attractive form of the crown seal cap blank and further enhances its appearance as a timepiece face.

In accordance with another embodiment of the invention, a crown seal cap blank, which may have colorful design or trademark thereon, is placed over a battery operated timepiece movement. A hole in the center of the crown seal cap blank accommodates the concentric time indication shafts (cannon pinon, hour wheel and second wheel) of the movement. Another hole in the skirt of the crown seal cap blank accommodates the stem used for adjusting the radial position of the concentric shafts. Appropriate time indication hands may be fixed to the concentric shafts after the blank is in place.

A crystal, at least partially transparent and having a downwardly and outwardly flaring skirt matching, in form, that of the crown seal cap blank, protects the blanks, hands and movement, while making the hands and the design or trademark, if present, visible. Means are provided for integrating the crystal, crown seal cap blank and movement with a timepiece case. A crown (adjustment knob) may be attached to the stem exterior to the crystal.

In accordance with another aspect of the invention, the case, the integration means, the crown, and the crystal may each have colors that further augment and enhance the appearance of the crown seal cap blank and the timepiece.

In accordance with another embodiment of the invention, a timepiece is provided for wearing on the owner's body as a wrist watch, in which instance the watch band may also have color to further augment and enhance the appearance of the crown seal cap blank and the wrist watch.

The novel features of the invention are set forth with particularity in the appended claims. The invention will be best understand from the following description when read in conjunction with the accompanying drawings.

MODES FOR CARRYING OUT THE INVENTION

Figure 1:
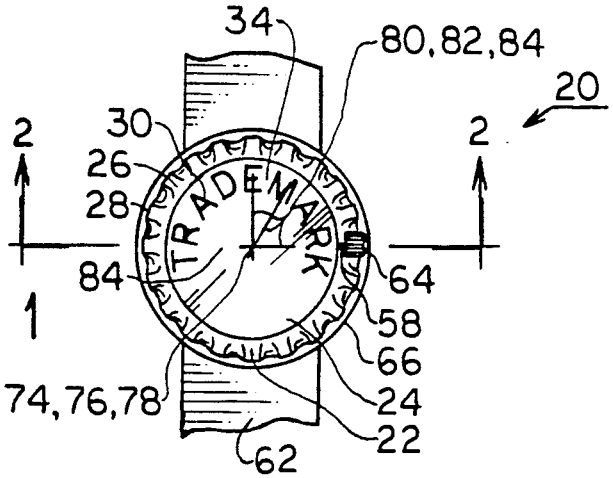
FIG. 1 is a plan view of a wrist watch having a crown seal cap blank as a face, in accordance with a preferred embodiment of the present invention.
Figure 2:
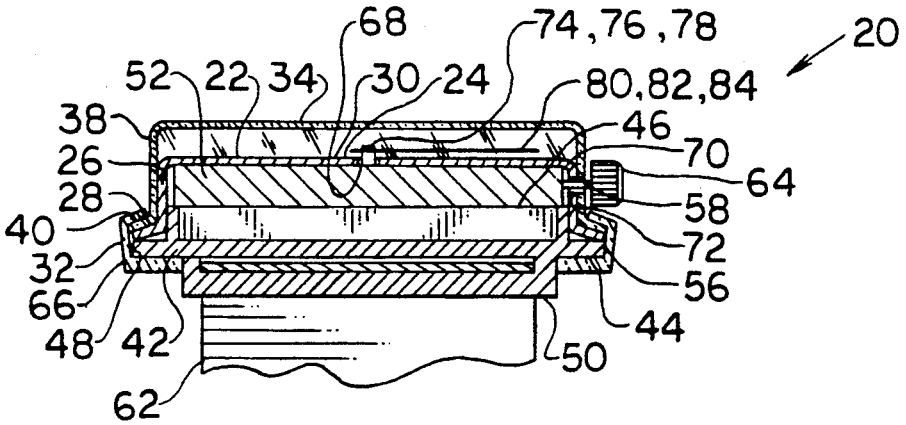
FIG. 2 is a sectional view along the line 2—2 of FIG. 1.

FIG. 1 is a plan view, in accordance with one embodiment of the present timepiece invention, illustrating the crown seal cap blank 22 and a wrist watch 20 having a crown seal cap blank 22 as a face. The downwardly extending skirt 26 of the blank 22 terminates in an outwardly flared and ribbed margin 28. The roof 24 of the crown seal cap blank 22 may bear a design or trademark 30. A radial hand or hands, which may include a minute hand 80, an hour hand 82 and a second hand 84, are fixed to the time indication shafts, which may include a cannon pinon 74, hour wheel 76 and second wheel 78, that protrude through the crown seal cap blank roof 24. A crystal 34, covering the crown seal cap blank 22, is at least partially transparent so that the crown seal cap blank roof 24, design or trademark 30 and the hands 80, 82 and 84 are visible. A crown 64 is mounted on the stem 58 of the watch movement 52 (as seen in FIG. 2) for adjustment of the radial position of the hands 80, 82 and 84. The wrist watch 20 includes a band 62 for attachment of the wrist watch 20 to a wrist.

FIG. 2 is a sectional view of the wrist watch 20 embodiment of the present timepiece invention along the line 2—2 of FIG. 1. The crown seal cap blank 22 is shown with its roof 24 and downwardly extending skirt 26. The crown seal cap blank skirt 26 terminates in an outwardly flared and ribbed margin 28. The crystal 34 has a similar downwardly extending skirt 38 terminating in an outwardly flared and ribbed margin 40. The crown seal cap blank roof 24 may carry a design or trademark 30.

The watch movement 52, which may be battery operated, sits in the top 46 of the case 42. The crown seal cap blank 22 fits over the movement 52 and the top 46 of the case 42. The hands 80, 82 and 84 are mounted on the time indication shafts 74, 76 and 78 which protrude through the crown seal cap blank roof hole 68. The crystal 34 lies on top of the crown seal cap blank 22. The stem 58 protrudes through the crown seal cap blank skirt hole 70 and the crystal skirt hole 72. The crown 64 mounts on the stem 58.

A means 32 for integrating the case 42, crown seal cap blank 22, and crystal 34 is provided. One embodiment of the integration means 32 is shown in FIG. 2 in the form of a resilient ring 66 which envelopes the case perimeter 48, the crown seal cap blank margin 28 and the crystal margin 40. The ring 66 may be at least partially transparent so as not to obscure the crown seal cap blank margin 28 and the crystal margin 40. A clip 50 is an integral part of the bottom 44 of the case 42. The clip 50 is open on one side and resilient, allowing the band 62 to be removed from the clip 50 and replaced by another band.

Figure 3:
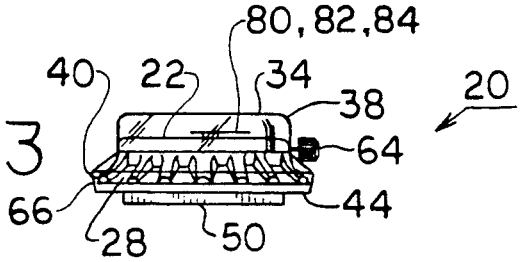
FIG. 3 is an elevation view of a wrist watch having a crown seal cap blank as a face, in accordance with a preferred embodiment of the present invention.

FIG. 3 is an elevation view of the wrist watch 20 embodiment and crown seal cap blank 22 with the band not shown for clarity. The hands 80, 82 and 84 are visible through the crystal 34. The crystal 34 sits upon the crown seal cap blank 22. The crystal margin 40 and the crown seal cap blank margin 28 are contained in the resilient ring 66. The clip 50, part of the bottom 44, is visible beneath the ring 66.

Figure 4:
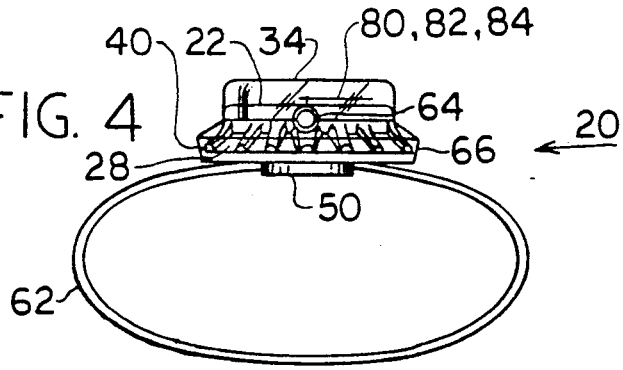
FIG. 4 is an elevation view, from another side, of a wrist watch having a crown seal cap blank as a face, in accordance with a preferred embodiment of the present invention.

FIG. 4 is an elevation view of the wrist watch 20 embodiment and crown seal cap blank 22 looking directly at the crown 64. The hands 80, 82 and 84 are visible through the crystal 34 which sits upon the crown seal cap blank 22. The resilient ring 66 envelopes the crystal margin 40 and the crown seal cap blank margin 28. The band 62 is slipped within the clip 50. In the embodiment shown, the band 62 is an endless resilient band which can be slipped upon a wrist.

Figure 5:
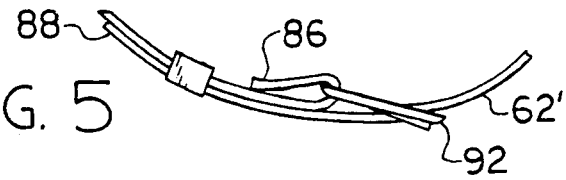
FIG. 5 is an partial view of another preferred embodiment of the present invention.

FIG. 5 is a partial view of the band 62' illustrating another embodiment in which the band 62' has a first end 86, a second end 88. Means for joining the two ends may be a buckle 92 on the first end 86.

Figure 6:
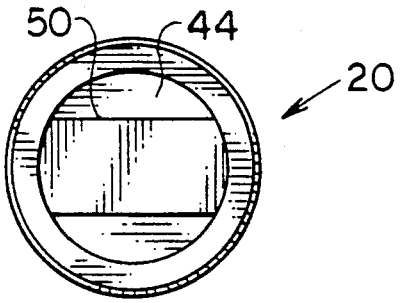
FIG. 6 is a bottom view of a wrist watch having a crown seal cap blank as a face, in accordance with a preferred embodiment of the present invention.

FIG. 6 is a plan view showing the bottom 44 of the wrist watch 20 embodiment. The clip 50 is shown without the band for clarity.

It may be appreciated from the figures that particular colors may be used for the case 42, integration means 66, crystal 34, crown 64, and band 62 to augment and enhance the appearance of the design or trademark 30 and the crown seal cap blank 22. In addition, the ease of assembly of the wrist watch 20 allows the band 62 and the resilient ring 66 to be changed in order to select colors appropriate for the occasion of the moment.

Figure 7:
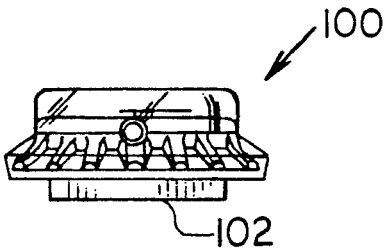
FIG. 7 is an elevation view, in accordance with another preferred embodiment of the present timepiece invention, illustrating attachment means of a timepiece having a crown seal cap blank as a face.

FIG. 7 is a perspective view of another embodiment of the present invention in which a timepiece 100, as described above for the particular embodiment of a wrist watch 20, is mounted to items, as may be desired by the owner, with attachment means 102. Examples of such items are in automobile instrument panel, an automobile sunvisor, a desk top, a mantle, a motorcycle, a boat and a well. Examples of the attachment means are double backed tape, hook and eye fasteners, magnets, brackets and stands.

It may be seen that a timepiece has been provided that can be suitable for a variety of uses and occasions. Although the present invention has been described with reference to preferred embodiments, numerous modifications and rearrangements can be made, and still the result will come within the scope of the invention.

What is claimed is:

1. A timepiece, comprising:

a case having a bottom, a top and a perimeter;

a movement having a side and a front, said movement having a concentric cannon pinion and hour wheel located in said front, radial positions of said cannon pinion and hour wheel indicative of time, said movement mounted on said top;

a crown seal cap blank having a roof and a downwardly extending skirt, said crown seal cap blank skirt having a margin, said crown seal cap blank margin outwardly flared and ribbed, said crown seal cap blank roof having a hole therein, said crown seal cap blank mounted on said top, said cannon pinion and said hour wheel protruding through said crown seal cap blank roof hole;

a minute hand removably mounted on said cannon pinion, radial position of said minute hand thus indicative of time;

an hour hand removably mounted on said hour wheel, radial position of said hour hand thus indicative of time;

a crystal having a roof and a downwardly extending skirt, said crystal skirt having a margin, said crystal margin outwardly flared and ribbed, said crystal at least partially transparent, said crystal mounted over said crown seal cap blank, said minute hand and said hour hand visible through said crystal; and means located at said perimeter, for integrating said case, said crown seal cap blank and said crystal.

2. A timepiece as defined in claim 1, wherein said crown seal cap blank roof has an exterior surface and said exterior surface has a design thereon, said design visible through said crystal.

3. A timepiece as defined in claim 2, wherein said design is a trademark.

4. A timepiece as defined in claim 1, wherein said crown seal cap blank margin and said crystal margin each have a hole therein, said movement has a stem on said side, radial positions of said cannon pinion and said hour wheel controllable by radial position of said stem, said stem protruding through said crown seal cap blank margin hole and said crystal margin hole and further comprising a crown, said crown removably mounted on said stem.

5. A timepiece as defined in claim 1, wherein said integrating means comprises a resilient ring, said ring containing said perimeter, said crown seal cap blank margin and said crystal margin.

6. A timepiece as defined in claim 1, wherein said crown seal cap blank roof has an exterior surface, said exterior surface having a trademark thereon, said trademark visible through said crystal;

said crown seal cap blank margin and said crystal margin each have a hole therein, said movement has a stem on said side, radial positions of said cannon pinion and said hour wheel controllable by radial position of said stem, said stem protruding through said crown seal cap blank margin hole and said crystal margin hole;

said integrating means comprises a resilient ring, said ring containing said perimeter, said crown seal cap blank margin and said crystal margin; and further comprising:

a crown, said crown removably mounted on said stem; and means attached to said case bottom for attaching said case bottom to a surface; and wherein said case, said attaching means, said crown, said hands and said ring each have color to complement said trademark.

7. A timepiece as defined in claim 6, wherein said attaching means comprises a band adapted to enclose a wrist, said band having color to complement said trademark and wherein said case bottom has a resilient clip, said clip thus adapted to slip over said band, said case removably attached to said band by said clip.

8. A timepiece, comprising:

a case having a bottom, a top and a perimeter;

a movement having a side and a front, said movement having a concentric cannon pinion and hour wheel located in said front, radial positions of said cannon pinion and hour wheel indicative of time, said movement mounted on said top;

a crown seal cap blank having a roof and a downwardly extending skirt, said crown seal cap blank skirt having a margin, said crown seal cap blank margin outwardly flared and ribbed, said crown seal cap blank roof having a hole therein, said crown seal cap blank mounted on said top, said cannon pinion and said hour wheel protruding through said crown seal cap blank roof hole;

a minute hand removably mounted on said cannon pinion, radial position of said minute hand thus indicative of time;

an hour hand removably mounted on said hour wheel, radial position of said hour hand thus indicative of time;

a crystal mounted over said crown seal cap blank for covering thereof, said crystal having a roof and a downwardly extending skirt, said crystal skirt having a margin outwardly flared and ribbed, said minute hand and said hour hand visible through said crystal; and means, located at said perimeter, for integrating said case, said crown seal cap blank and said crystal.

9. A timepiece as defined in claim 8, wherein said integrating means comprises a resilient ring, said ring containing said perimeter, said crown seal cap blank margin and said crystal margin.

10. A timepiece as defined in claim 9 further comprising:

means, attached to said case bottom, for attaching said case bottom to a surface; and wherein:

said case, said attaching means, said crown, said hands and said ring each have color to complement said trademark.

11. A timepiece as defined in claim 10, wherein said attaching means comprises a band adapted to enclose a wrist, said band having color to complement said trademark and wherein said case bottom has a resilient clip, said clip thus adapted to slip over said band, said case removably attached to said band by said clip.

* * * * *